United States Patent [19]

Nanda

[11] 4,418,612

[45] Dec. 6, 1983

[54] POWER TRANSMISSION

[75] Inventor: Vinod K. Nanda, Rochester, Mich.

[73] Assignee: Vickers, Incorporated, Troy, Mich.

[21] Appl. No.: 267,853

[22] Filed: May 28, 1981

[51] Int. Cl.[3] ..... F15B 13/04

[52] U.S. Cl. ..... 91/445; 91/446; 251/28; 251/38

[58] Field of Search ..... 91/445, 446, 468, 448, 91/454, 455, 457; 251/28, 29, 38, 44

[56] References Cited

U.S. PATENT DOCUMENTS

| | | | |
|---|---|---|---|
| 3,964,505 | 6/1976 | McAvoy | 91/455 |
| 3,972,267 | 8/1976 | Hook et al. | 91/455 |
| 4,006,667 | 2/1977 | Bianchetta et al. | 91/445 |
| 4,138,929 | 2/1979 | Peterson | 91/446 |
| 4,201,052 | 5/1980 | Breeden et al. | 91/454 |
| 4,353,289 | 10/1982 | Lonnemo | 91/455 |

*Primary Examiner*—Robert E. Garrett
*Assistant Examiner*—Richard S. Meyer
*Attorney, Agent, or Firm*—Barnes, Kisselle, Raisch, Choate, Whittemore & Hulbert

[57] ABSTRACT

A hydraulic control system comprising a hydraulic actuator having opposed openings adapted to alternately function as inlets and outlets for moving the element of the actuator in opposite directions, a pump for supplying fluid to the actuator, pilot operated meter-in valve means to which the fluid from the pump is supplied for controlling the direction of movement of the actuator, meter-out valve means associated with each opening of the actuator for controlling the flow out of said actuator, and a pilot operated check valve operable for controlling flow from the meter-in valve means to one end of the actuator and for preventing flow out the end of said actuator, the pilot operated check valve being operable at a lower pilot pressure than the meter-out valve means and including time delay means such that the valve functions to prevent flow out of the actuator after a predetermined time delay from the time when pilot pressure to said meter-out valve means is interrupted, insuring relief valve protection.

6 Claims, 3 Drawing Figures

POWER TRANSMISSION

This invention relates to power transmissions and particularly to hydraulic circuits for actuators such as are found on cranes.

BACKGROUND AND SUMMARY OF THE INVENTION

In U.S. Pat. No. 4,201,052 and copending application Ser. No. 117,936, filed Feb. 4, 1980, having a common assignee with the present application, there is disclosed hydraulic circuits which include a valve assembly, comprising a pilot operated meter-in valve and pilot operated meter-out valve, which is preferably mounted directly on an actuator.

In such a system when used in cranes and the like it is desirable to prevent drift when the load is held in an elevated position. The present invention is intended particularly to provide a hydraulic system of the above described type which will effectively prevent drift in such applications.

Basically, the invention comprises the above described hydraulic circuit including interposing a pilot operated check valve between the meter-out valve and the opening to one end of the actuator which is operable to permit flow or interrupt to the actuator and incorporates time delay means so that it closes after the meter-out valve closes. The pilot operated check valve also is operable to open before the meter-out valve.

DESCRIPTION OF THE DRAWINGS

Referring to FIG. 1, the hydraulic system embodying the invention comprises an actuator 20, herein shown as a hydraulic cylinder, having a rod 21 that is moved in opposite directions by hydraulic fluid supplied from a variable displacement pump system 22 which has load sensing control in accordance with conventional construction. The hydraulic system further includes a manually operated controller, not shown, that directs a pilot pressure to a valve system 24 for controlling the direction of movement of the actuator, as presently described. Fluid from the pump 22 is directed to the line 25 and line 26 to a meter-in valve 27 that functions to direct and control the flow of hydraulic fluid to one or the other end of the actuator 20. The meter-in valve 27 is pilot pressure controlled by controller, not shown, through lines 28, 29 and lines 30, 31 to the opposed ends thereof, as presently described. Depending upon the direction of movement of the valve, hydraulic fluid passes through lines 32, 33 to one or the other end of the actuator 20.

Figure 1:
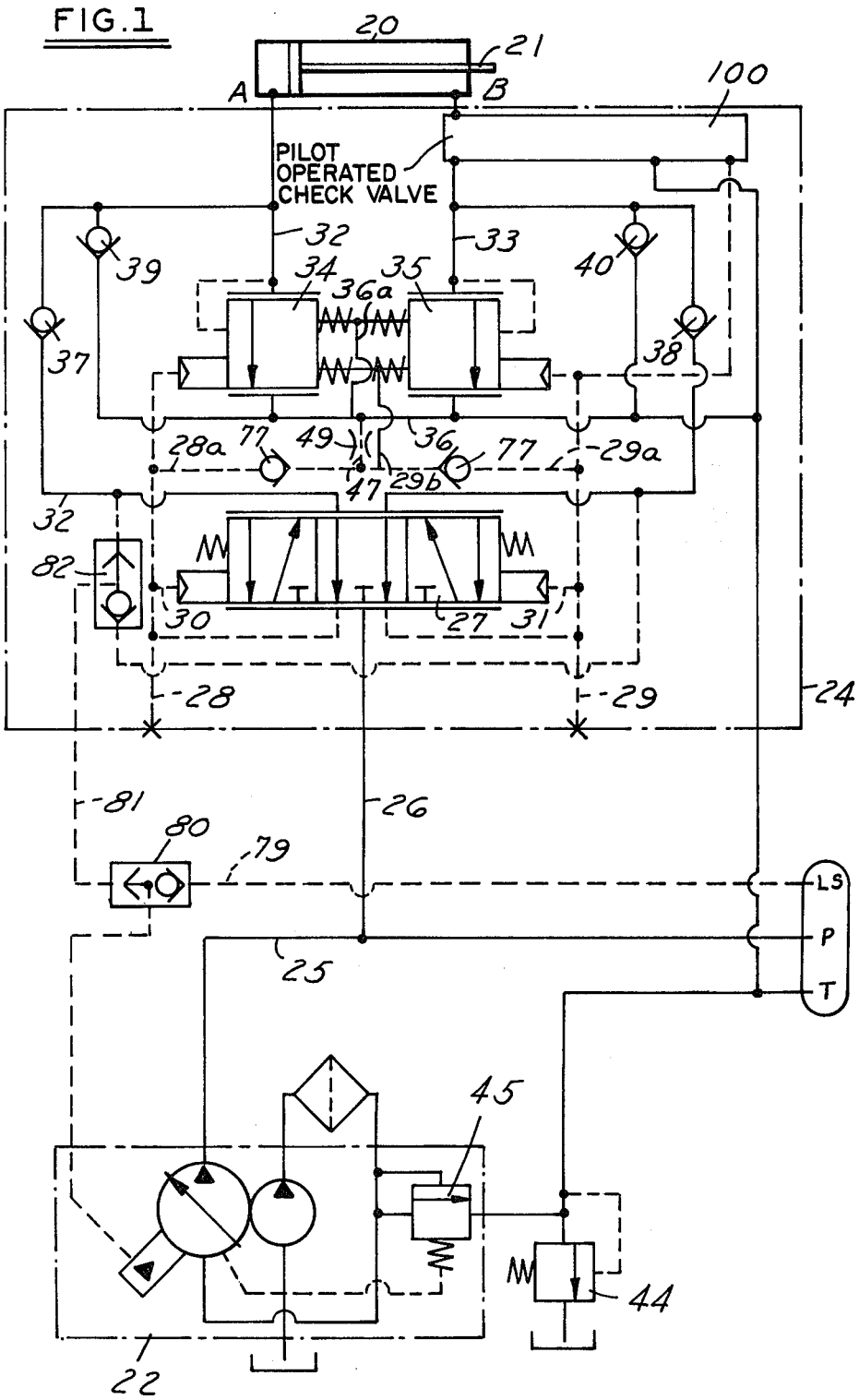
FIG. 1 is a schematic drawing of a hydraulic circuit embodying the invention.

The hydraulic system further includes a meter-out valve 34, 35 associated with each end of the actuator in lines 32, 33 for controlling the flow of fluid from the end of the actuator to which hydraulic fluid is not flowing from the pump to a tank passage 36, as presently described.

The hydraulic system further includes spring loaded poppet valves 37, 38 in the lines 32, 33 and spring loaded anti-cavitation valves 39, 40 which are adapted to open the lines 32, 33 to the tank passage 36. In addition, spring loaded poppet valves, not shown, are associated with each meter-out valves 34, 35 acting as pilot operated relief valves. A bleed line 47 having an orifice 49 extends from passage 36 to meter-out valves 34, 35 and to the pilot control lines 28, 29 through check valves 77 in branch lines **28*a*, 29*a*. The spring ends of meter-out valves 34, 35 are connected to lines 36, 29*a* by lines 36*a*, 29*b***, respectively.

The system also includes a back pressure valve 44 associated with the return or tank line. Back pressure valve 44 functions to minimize cavitation when an overrunning or a lowering load tends to drive the actuator down. A charge pump relief valve 45 is provided to take excess flow above the inlet requirements of the pump 22 and apply it to the back pressure valve 44 to augment the fluid available to the actuator.

Meter-in valve 27 comprises a bore in which a spool is positioned and the absence of pilot pressure maintained in a neutral position by springs. The spool normally blocks the flow from the pressure passage 26 to the passages 32, 33. When pilot pressure is applied to either passage 30 or 31, the meter-in spool is moved in the direction of the pressure until a force balance exists among the pilot pressure, the spring load and the flow forces. The direction of movement determines which of the passages 32, 33 is provided with fluid under pressure from passage 26.

When pilot pressure is applied to either line 28 or 29, leading to meter-out valves 34 or 35, the valve is actuated to vent the associated end of acutator 20 to tank passage 36.

It can thus be seen that the same pilot pressure which functions to determine the direction of opening of the meter-in valve also functions to determine and control the opening of the appropriate meter-out valve so that the fluid in the actuator can return to the tank line.

In the case of an energy absorbing load, when the controller is moved to operate the actuator 20 in a predetermined direction, pilot pressure applied through line 28 and passage 30 moves the spool of the meter-in valve to the right causing hydraulic fluid under pressure to flow through passage 33 opening valve 38 and continuing to the inlet B of actuator 20. The same pilot pressure is applied to the meter-out valve 34 permitting the flow of fluid out of the end of the actuator 20 to the return or tank passage 36.

When the controller is moved to operate the actuator, for example, for an overrunning or lowering a load, the controller is moved so that pilot pressure is applied to the line 28. The meter-out valve 34 opens before the meter-in valve 27 under the influence of pilot pressure. The load on the actuator forces hydraulic fluid through the opening A of the actuator past the meter-out valve 34 to the return or tank passage 36. At the same time, the valve 40 is opened permitting return of some of the fluid to the other end of the actuator through opening B thereby avoiding cavitation. Thus, the fluid is supplied to the other end of the actuator without opening the meter-in valve 27 and without utilizing fluid from the pump.

To achieve a float position, the controller is bypassed and pilot pressure is applied to both pilot pressure lines 28, 29. This is achieved, for example, by a circuit, not shown which will apply the fluid from a pilot pump directly to lines 28, 29 causing both meter-out valves 34 and 35 to open and thereby permit both ends of the actuator to be connected to tank pressure. In this situation, the meter-out valves function in a manner permitting fluid to flow back and forth between opposed ends of the cylinder.

By varying the spring forces and the areas on the meter-in valve 27 and the meter-out valves 34, 35, the timing between these valves can be controlled. Thus, for example, if the timing is adjusted so that the meter-out valve leads the meter-in valve, the meter-in valve will control flow and speed in the case where the actuator is being driven. In such an arrangement with an overhauling load, the load-generated pressure will result in the meter-out valve controlling flow and speed. In such a situation, the anti-cavitation check valves 39, 40 will permit fluid to flow to the supply side of the actuator so that no pump flow is needed to fill the actuator in an overhauling load mode or condition.

A check valve 77 is provided in a branch of each pilot line 28, 29 adjacent each meter-out valve 34, 35. The valves 77 allow fluid to bleed from the high tank pressure in passage 36, which fluid is relatively warm, and to circulate through pilot lines 28, 29 back to the controller and the fluid reservoir when no pilot pressure is applied to the pilot lines 28, 29. When pilot pressure is applied to a pilot line, the respective check valve 77 closes isolating the pilot pressure from the tank pressure.

Provision is made for sensing the maximum load pressure in one of a multiple of valve systems 24 controlling a plurality of actuators and applying that higher pressure to the load sensitive variable displacement pump 22. Each valve system 24 includes a line 79 extending to a shuttle valve 80 that receives load pressure from an adjacent actuator through line 81. Shuttle valve 82 senses which of the pressures is greater and shifts to apply the higher pressure to pump 22. Thus, each valve system in succession incorporates shuttle valves 80, 82 which compare the load pressure therein with the load pressure of an adjacent valve system and transmit the higher pressure to the adjacent valve system in succession and finally apply the highest load pressure to pump 22.

The above described circuit is shown and described in the aforementioned U.S. Pat. No. 4,201,052 and application Ser. No. 117,936. The single meter-in valve 27 may be replaced by two meter-in valves as described in the aforementioned application Ser. No. 117,936.

The details of the preferred construction of the elements of the hydraulic circuit are more specifically described in the aforementioned U.S. Pat. No. 4,201,052 and application Ser. No. 117,936 which are incorporated herein by reference.

In accordance with the invention, a pilot operated check valve 100 is interposed between the end of the actuator 20 and its respective meter-out valve 35 which might permit drift by leakage under load, as in the case of an elevated load. If such a condition might occur then a pilot operated check valve in accordance with the invention would be utilized with each end of the actuator.

The pilot operated check valve 100 functions to open in response to a lesser pilot pressure than the meter-out valve and includes a time delay so that it closes after a predetermined time from the time the pilot pressure to the meter-out valve is removed.

Figure 2:
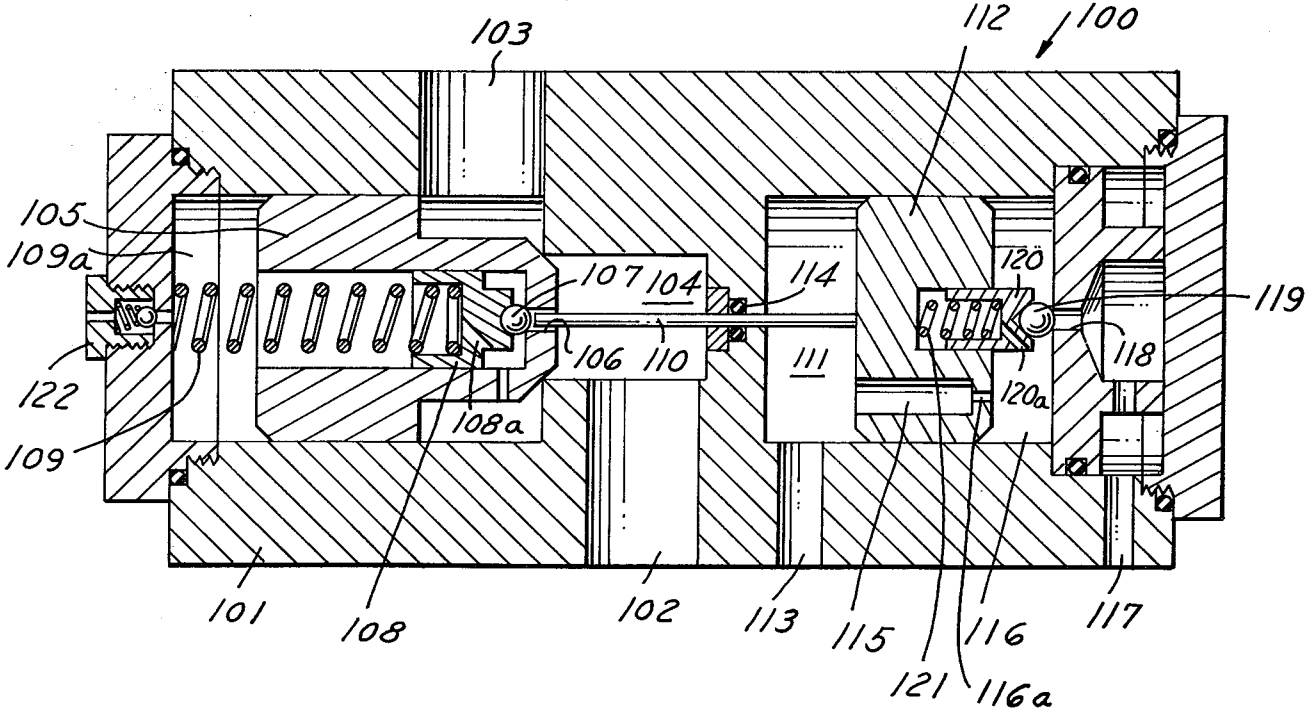
FIG. 2 is a cross-sectional view of a specific embodiment of the pilot operated check valve utilized in the hydraulic system shown in FIG. 1.

A preferred form of pilot operated check valve 100 is shown in FIG. 2 and comprises a body 101 having a port 102 adapted to communicate with line 33 and a port 103 adapted to communicate with end B of the actuator 20. Ports 102, 103 extend to a chamber 104 and a check valve 105 is adapted to open or close communication between ports 102, 103. Valve 105 includes an axial opening 106 normally closed by a ball 107 which is yieldingly urged into closed position by a guide 108 and spring 109. A passage **108*a* equalizes the pressure between opposite sides in guide member 108. A pin 110 extends between chamber 104 and a separate chamber 111 in body 101 in which a piloting piston 112 is positioned. Chamber 111 communicates with a tank passage in the valve assembly through a port 113. A sealing ring 114 engages pin 110 and hydraulically isolates chambers 104, 111**.

Piloting piston 112 includes an orifice **116*a* providing metered communication between chamber 111 and a chamber 116. Body 101 includes a pilot pressure port 117 adapted to be connected to a pilot line 29 in valve assembly for applying pilot pressure to the valve 100 through axial passage 118. Passage 118 is normally closed by a ball check 119 yieldingly urged against passage 118 by a guide member 120 and spring 121 in piloting piston 112. A passage 120*a* equalizes the pressure between opposite sides of guide member 120. In addition, a spring loaded thermal relief valve 122 is provided to relieve excessive hydraulic pressure in the chamber 109*a* containing spring 109** as would occur upon expansion due to heating of the fluid beyond a predetermined pressure.

The parts and stroke of movements are sized so that the pilot operated check valve 100 will open at a lesser pilot pressure than the meter-out valve. As a result, when pilot pressure is applied to open the meter-out valve the pilot operated check valve 100 will open moving piloting piston 112 and pin 110 to open valve 105 before the meter-out valve opens. When pilot pressure is removed from the meter-out valve, the orifice **116*a* and ball check 119 function to delay closing of the valve 105 ensuring relief valve protection of the load. When valve 105 finally closes the load on actuator 20** is locked and prevented from drifting.

The valve 100 is designed with a high pilot ratio so that the low pilot pressure will open valve 105 against the pressure of a high load in actuator 20. When the pin 110 lifts the ball 107 relieving pressure in chamber **109*a*, check valve 105 will be lifted open due to the higher pressure in chamber 103 and the reduced pressure at 109*a***.

Figure 3:
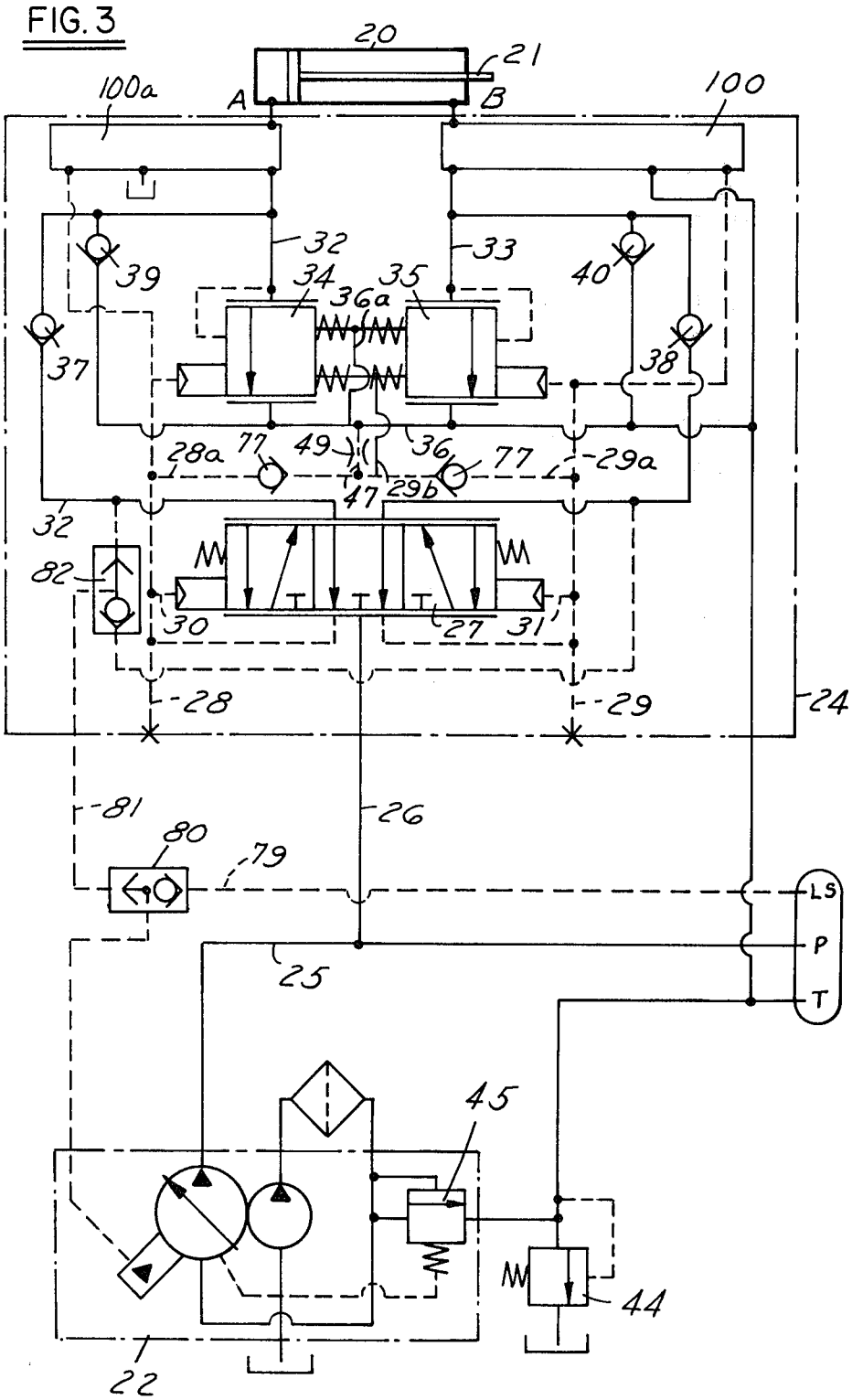
FIG. 3 is a schematic drawing of a hydraulic circuit of a modified form of the invention.

If the hydraulic system requires the prevention of hydraulic drift of the actuator in the opposite direction, a second pilot operated check valve **100*a* of identical construction as valve 100 is provided in association with opening A of the actuator as shown in FIG. 3**.

What is claimed is:

1. A hydraulic control system comprising a hydraulic actuator having opposed openings adapted to alternately function as inlets and outlets for moving the element of the actuator in opposite directions, a pump for supplying fluid to said actuator, a meter-in valve means to which the fluid from the pump is supplied, said valve being pilot controlled, a pilot controller for alternately supplying fluid at pilot pressure to said meter-in valve means for controlling the direction of movement of the meter-in valve, a pair of hydraulic lines extending from said meter-in valve means to said respective openings of said actuator, a normally closed meter-out valve associated with each opening of the actuator for controlling the flow out of said actuator, each said meter-out valve being pilot operated by the pilot pressure from said controller, and a pilot operated check valve in one of said pair of lines between said actuator and its respective meter-out valve operable for controlling flow from the meter-in valve means to one end of said actuator and for preventing flow out said end of said actuator, said pilot operated check valve being operable at a lower pilot pressure than said meter-out valve means such that said check valve opens before its associated meter-out valve opens, said check valve including time delay means such that said valve functions to prevent flow out of said actuator after a predetermined time delay from the time when pilot pressure to said meter-out valve means is interrupted, insuring relief valve protection.

2. The hydraulic system set forth in claim 1 including a second substantially identical pilot operated check valve associated with the other end of said actuator for controlling flow out of said other end of said actuator, said second check valve being operable for controlling flow from the meter-in valve means to the other end of said actuator and for preventing flow out of said other end of the actuator, said second pilot operated check valve being operable at a lower pilot pressure than the associated meter-out valve means such that said check valve opens before its associated meter-out valve opens, said check valve including time delay means such that said valve functions to prevent flow out of said actuator after a predetermined time delay from the time when pilot pressure to said meter-out valve means is interrupted, insuring relief valve protection.

3. The hydraulic system set forth in claim 1 wherein said check valve is contained in a unitary body.

4. The hydraulic system set forth in claim 3 wherein said pilot operated check valve comprises a first port communicating with said hydraulic line to the meter-out valve and a second port communicating with said one end of said actuator, a chamber to which said ports extend, a check valve adapted to open and close communication between said ports, said check valve including an axial opening, a normally closed ball, a guide member, means yieldingly urging said guide member and said ball into closed position, a passage in said guide member equalizing pressure between opposite sides of said guide member, a separate chamber in said body, a piloting piston in said separate chamber, said separate chamber communicating with a low pressure passage, a pin extending between said piston in said separate chamber and said first mentioned chamber for engaging said ball, said piloting piston including an orifice providing metered communication between the chambers upstream and downstream of said piloting piston, said body including a pilot pressure port connected to pilot pressure for applying pilot pressure to said piloting piston.

5. The hydraulic system set forth in claim 4 including a second check valve normally preventing flow through said pilot line to said separate chamber, said check valve comprising a ball and a guide member, an orifice in said guide member for equalizing the pressure on opposite sides of said guide member.

6. The hydraulic system set forth in claim 5 including a thermal relief valve in said body for relieving excessive pressure in said first mentioned chamber.

* * * * *